US012163457B2

(12) United States Patent
Mast

(10) Patent No.: US 12,163,457 B2
(45) Date of Patent: Dec. 10, 2024

(54) METHOD AND DEVICE FOR FILLING A HYDRAULIC SYSTEM WITH A HYDRAULIC FLUID

(71) Applicant: Daimler Truck AG, Leinfelden-Echterdingen (DE)

(72) Inventor: Jochen Gerhard Mast, Esslingen (DE)

(73) Assignee: Daimler Truck AG, Leinfelden-Echterdingen (DE)

( * ) Notice: Subject to any disclaimer, the term of this patent is extended or adjusted under 35 U.S.C. 154(b) by 0 days.

(21) Appl. No.: 17/784,511

(22) PCT Filed: Dec. 10, 2020

(86) PCT No.: PCT/EP2020/085435
§ 371 (c)(1),
(2) Date: Jun. 10, 2022

(87) PCT Pub. No.: WO2021/116251
PCT Pub. Date: Jun. 17, 2021

(65) Prior Publication Data

US 2023/0035802 A1 Feb. 2, 2023

(30) Foreign Application Priority Data

Dec. 11, 2019 (DE) ..... 10 2019 008 565.5
Mar. 6, 2020 (DE) ..... 10 2020 001 473.9

(51) Int. Cl.
*F01P 11/02* (2006.01)

(52) U.S. Cl.
CPC ..... *F01P 11/0204* (2013.01)

(58) Field of Classification Search
CPC ..... F01P 11/0204; F01P 2025/04; F01P 11/0276; F01P 11/028; F01P 11/0285; F01P 11/029; F01P 11/0295; F01P 2025/00
See application file for complete search history.

(56) References Cited

U.S. PATENT DOCUMENTS 5,218,840 A * 6/1993 Kolpak ..... G01N 33/2823 73/61.44
5,255,636 A * 10/1993 Evans ..... F01P 11/028 123/41.29

(Continued)

FOREIGN PATENT DOCUMENTS

CN 101408493 A * 4/2009
DE 10 2010 024 766 A1 12/2011

(Continued)

OTHER PUBLICATIONS

PCT/EP2020/085435, International Search Report dated Mar. 22, 2021 (Two (2) pages).

*Primary Examiner* — George C Jin
*Assistant Examiner* — Teuta B Holbrook
(74) *Attorney, Agent, or Firm* — Crowell & Moring LLP

(57) ABSTRACT

A method for filling a hydraulic system with a hydraulic fluid includes sealing the hydraulic system in a pressure-tight manner and recording a pressure in the sealed hydraulic system, filling or removing a predefined volume of the hydraulic fluid from the sealed hydraulic system, recording a pressure in the sealed hydraulic system after the filling or removing, calculating a volume of a total residual air in the hydraulic system depending on the pressures before and after the filling or removal of the predefined volume, calculating a final correction volume depending on the volume and a design-specified air feed of the hydraulic system, and refilling or removing the calculated final correction volume to achieve a final correct filling quantity for the hydraulic system.

11 Claims, 3 Drawing Sheets

(56) References Cited

U.S. PATENT DOCUMENTS

| | | | | |
|---|---|---|---|---|
| 5,868,105 | A * | 2/1999 | Evans | F01P 9/00 123/41.5 |
| 2005/0067048 | A1 | 3/2005 | Few | |
| 2007/0026534 | A1 * | 2/2007 | Graham | B01L 3/0217 436/180 |
| 2015/0345368 | A1 * | 12/2015 | Le Poul | B65D 51/1644 123/41.51 |
| 2018/0266306 | A1 * | 9/2018 | Dumas | F01P 11/029 |

FOREIGN PATENT DOCUMENTS

| | | | | |
|---|---|---|---|---|
| DE | 10 2015 209 966 | A1 | 12/2016 | |
| DE | 102015008465 | A1 * | 1/2017 | |
| EP | 3330512 | A1 * | 6/2018 | F01P 11/0285 |
| KR | 101243582 | B1 * | 3/2012 | |
| KR | 101802705 | B1 * | 12/2017 | |
| WO | WO-2016089278 | A1 * | 6/2016 | F01P 11/029 |

* cited by examiner

METHOD AND DEVICE FOR FILLING A HYDRAULIC SYSTEM WITH A HYDRAULIC FLUID

BACKGROUND AND SUMMARY OF THE INVENTION

The invention relates to a method for filling a hydraulic system, in particular a cooling system of a motor vehicle, and to a device for filling a hydraulic system. The term "hydraulic system" in the sense of the invention comprises a system at least partially filled with a fluid or a fluid mixture, comprising reservoirs, pipes, hoses, a compensating or storage reservoir, heat exchangers, coolers, one or more pumps or hydraulic motors and/or other components. The hydraulic system may be closed during operation or may be in communication with the ambient air, for example via a vent of the optional compensating reservoir. The terms "quantity" and "volume" are used synonymously in the following.

The cooling system of a mobile or stationary internal combustion engine is an example of such a hydraulic system. Further examples are vehicles with alternative drive systems (for example plug-in hybrid, electric drive, fuel cell), hydraulic steering assistance of a motor vehicle, the working hydraulics of a construction machine or an agricultural implement, or a stationary device. The invention is explained below using the example of a cooling system of a vehicle, without limiting the claimed protection thereto.

Vehicles with various different hydraulic systems are already sufficiently known from the general prior art and in particular from vehicle construction. The vehicle is designed, for example, as a commercial vehicle with an internal combustion engine. Its cooling system usually has at least one cooling circuit, through which a coolant, in particular a liquid coolant, can flow. Various components of the vehicle (for example the internal combustion engine, one or more (water-cooled) turbochargers), retarders, one and/or one or more coolers/heat exchangers are arranged in the cooling circuit, wherein the first-mentioned or other components can be cooled or temperature-controlled by the coolant. The cooler(s)/heat exchanger(s) ultimately dissipate the heat absorbed by the cooling fluid to other consumers in the system or to the ambient air. The compensating reservoir is used to compensate for volume fluctuations of the coolant in the cooling system. These volume fluctuations result, for example, from temperature fluctuations and/or from leaks. This is known to a person skilled in the art and therefore requires no further explanation.

Before the first start-up, for example during final assembly of the vehicle, each hydraulic system must be filled with a sufficient quantity of hydraulic fluid. A sufficient quantity/volume of coolant must be filled into the cooling system. Neither too much nor too little coolant and hydraulic fluid must be filled. In addition, filling should be carried out quickly and reliably. Filling is made more difficult by the fact that complicated hydraulic systems in particular are shaped in such a way that the hydraulic fluid does not reach all regions of the hydraulic system when it is conveyed into the hydraulic system for example through the filling opening of a compensating reservoir. In the hydraulic system there remain air bubbles, the volume of which is unknown.

Sufficient cooling of the vehicle or its components can only be achieved if there is a sufficient quantity of coolant in the cooling system. However, an excessive quantity of coolant in the cooling system must be avoided as well as an insufficient quantity, since an excessive quantity as well as an insufficient quantity can cause damage to the vehicle.

In the series production of, for example, motor vehicles, an iterative filling of the cooling system with coolant is usually provided. After an initial filling of the cooling system, a drive unit, in particular an internal combustion engine, of the vehicle is started, so that the filled coolant in the cooling system or cooling circuit is conveyed by at least one pump (the so-called water pump). Usually, after the initial filling, there are residual air quantities (air bubbles) in the cooling system, which reach the compensating reservoir as a result of the pumping of the coolant through the cooling system, so that the level of the coolant in the compensating reservoir decreases after the initial filling due to the start-up of the water pump. Then, for example, a person carrying out the filling process can recognise visually or by means of level sensors, on the basis of this decrease in quantity, that the quantity of coolant in the cooling system is still too small and can add further coolant to the cooling system. This iterative filling process is time-consuming and costly, error-prone and requires starting the internal combustion engine and, if necessary, opening any thermostats and/or shut-off valves that may be present in the system, for example heating valves for the vehicle's passenger compartment heating. The opening of the thermostat can—if possible—be force-controlled or must be brought about by reaching the thermostat opening temperature in the cooling system, which is relatively time-consuming in a production line. The situation is similar when filling other hydraulic systems.

DE 10 2015 008 465 A1 discloses a method for filling a cooling system of a vehicle, in which an attempt is made, using the ideal gas equation, to adjust the quantity of coolant depending on a residual volume located in a compensating reservoir of the cooling system.

It is therefore the object of the present invention to provide a method and a device for carrying out the method, by means of which a cooling system of a vehicle, and any other hydraulic system, can be filled with a coolant or other fluid quickly, precisely, and in a simple manner. The method shall be reliable and automatable.

In accordance with the invention, this object is achieved by a method for filling a hydraulic system with a hydraulic fluid, which method comprises the following method steps:

- filling the hydraulic system with a predefined first volume ($V_{KM,\ Prefill}$) of hydraulic fluid,
- sealing the hydraulic system in a pressure-tight manner and recording the pressure ($p_{2,\ abs}$) in the sealed hydraulic system,
- filling or removing a predefined second volume ($\Delta V_{KM,\ Mess}$) of hydraulic fluid from the sealed hydraulic system,
- recording the pressure ($p_{3,\ abs}$) in the sealed hydraulic system after filling or removing the second volume ($\Delta V_{KM,\ Mess}$),
- calculating the volume ($V_3$) of the total residual air in the hydraulic system depending on the pressures ($p_{2,\ abs}$, $p_{3,\ abs}$) before and after filling with the second volume ($\Delta V_{KM,\ Mess}$), and calculating a final correction volume ($V_{KM,\ korr}$) depending on the volume ($V_3$) and the design-specified air feed of the system $V_{L,\ AGB}$ and
- refilling or removing the calculated final correction volume ($V_{KM,\ Korr}$) to achieve the final correct filling quantity for the hydraulic system.

Alternatively, this object is achieved in accordance with the invention by a method for filling a hydraulic system with a hydraulic fluid, which method comprises the following method steps:

filling the hydraulic system with a predefined first volume ($V_{KM,\ Prefill}$) of hydraulic fluid, sealing the hydraulic system in a pressure-tight manner and recording the pressure ($P_{2,\ abs}$) in the sealed hydraulic system, filling or removing hydraulic fluid from the sealed hydraulic system until a predefined pressure ($p_{3,\ abs}$) reached in the sealed hydraulic system, and recording the volume abs) is ($\Delta V_{KM,\ Mess}$) of the hydraulic fluid filled in during this process, calculating the volume ($V_3$) of the total residual air in the hydraulic system depending on the pressures ($p_{2,\ abs}$, $p3_{,\ abs}$) before and after filling with the second volume ($\Delta V_{KM,\ Mess}$), and calculating a final correction volume ($V_{KM,\ korr}$) depending on the volume ($V_3$) and the design-specified air feed of the system $V_{L,\ AGB}$ and refilling or removing the calculated final correction volume ($W_{KM,\ Korr}$) to achieve the final correct filling quantity for the hydraulic system.

The method according to the invention makes it possible to determine the volume of the total residual air quantity present in the hydraulic system after the first filling and, depending on this and on the design-specified air feed of the system, to determine the volume of the hydraulic fluid still missing or filled in excessively (=final correction volume) and to convey this volume into the hydraulic system or to remove any excess quantity present. The volume of the total residual air quantity/the air bubbles is determined with the hydraulic system closed by pumping a defined volume of hydraulic fluid into the closed system or removing it from the system and precisely recording the absolute pressures before and after filling or removing the quantity. Using the (ideal) gas equation, the volume of the total residual air quantity, i.e., of the air bubbles and of the air volume in the compensating reservoir, can thus be determined with sufficient accuracy. Based on this result, the hydraulic system can then be filled with the final correction volume or an excessive quantity that is present in the system can be removed, thus completing the filling process.

This means, to return to the example of the "cooling system of a motor vehicle", that after the cooling system has been filled, the level of the coolant is above the maximum permissible level in the compensating reservoir before the first start-up of the internal combustion engine. Shortly after the first start-up and opening of all thermostats and/or shut-off valves, the level then drops once during operation of the system to the maximum permanently permissible level because the air bubbles are conveyed out of the system into the compensating reservoir.

Then, the design-specified air volume in a storage reservoir, for example a cooling system compensating reservoir, is also established. This desired and design-specified residual air volume in the compensating reservoir is referred to as the air feed $V_{L,AGB}$. The air feed is usually provided in order—in the case of a closed system—to cushion the pressure change triggered by temperature change by means of a defined compressible gas quantity, in this case air or steam, and thus to achieve a defined pressure build-up above the temperature increase of the coolant in the system, or—in the case of an open system—to provide a defined compensating space above the stored quantity in the reservoir in order to compensate for volume changes in the system before liquid can escape to the outside through the vent hole.

The desired air volume depends, for example, on the design-permitted maximum pressure of the system and any minimum pressure requirements of the components in the cooling system, and may vary depending on the cooling system.

The method according to the invention serves to determine the quantity to be filled in, even if the total volume of the hydraulic system is not known at the beginning of the method. Reasons for this are, for example, component tolerances, in particular concerning the cavities of the components located in the system, and/or an unknown residual quantity of hydraulic fluid in one or more components of the system; for example, a residual quantity of coolant remains in an internal combustion engine due to a previous test bench run in which the engine was filled with coolant, but an unknown residual quantity remains in cavities in the engine, even when the coolant is drained at the end of the test run. Also, different embodiments (for example for use in the tropics with a larger radiator or different wheelbases) may result in an unknown total volume of the system. The method according to the invention works reliably and accurately even without exact knowledge of the total volume.

Thus, it is possible to fill any hydraulic system, whether in a mobile or a stationary application, with exactly the desired quantity of hydraulic fluid. The method according to the invention can be used together with a so-called vacuum filling process. In the vacuum filling process, a negative pressure is created in the hydraulic system relative to the environment of the hydraulic system. This negative pressure is usually also referred to as a vacuum, although it is clear that this is not a pure vacuum, since such a pure vacuum cannot be generated technically or only with excessive effort. The negative pressure to which the hydraulic system is evacuated is, for example, a rough vacuum with approximately 50 millibars. This vacuum is helpful in the process and shortens the cycle time, as it allows the hydraulic fluid to be conveyed into the hydraulic system very quickly.

One advantage of the method according to the invention is that, during the filling process, it is irrelevant at which points there are residual quantities of air in the hydraulic system. Furthermore, it is not necessary to know the exact volume of the hydraulic system and any residual quantities of hydraulic fluid that may already be in the hydraulic system before the actual filling process. In practice, due to the variables mentioned above, it is not possible to determine the exact quantity of hydraulic fluid to be filled in advance.

In order to set the quantity of hydraulic fluid to be filled into the hydraulic system as accurately as possible, it is preferably provided that the quantity is determined via the gas equation. In this way, the quantity to be filled in can be determined particularly precisely in conjunction with the predefined air feed in the compensating reservoir. The gas equation or ideal gas equation thus forms a physical relationship on the basis of which the existing residual air volume in the hydraulic system, for example in the cooling circuit of a vehicle, can be determined within the scope of at least a two-point measurement.

The basis for this is an approximate isothermal change of state, which can be described according to the BOYLE-MARIOTTE law as $$p*V=\text{const, with } T=\text{const and } dT=0.$$

Since the required air feed in the hydraulic system for each vehicle or vehicle variant is design-specified and known, the necessary quantity of hydraulic fluid to be filled into the hydraulic system can be calculated so that each vehicle can be filled exactly, i.e., with the desired quantity. This makes it possible to fill the particular vehicle, system or device in a particularly short time and thus cost-effectively, so that iterative filling processes can be avoided. Furthermore, incomplete filling of vehicles or the like can be prevented, so that the risk of damage, which can result from insufficient filling, can be kept particularly low. Possible customer complaints due to missing quantities or overfilling can also be avoided.

Further advantages, features and details of the invention will become apparent from the following description of a preferred exemplary embodiment and from the drawings. The features and combinations of features mentioned above in the description, as well as the features and combinations of features mentioned below in the description of the figures and/or shown alone in the figures, can be used not only in the combination indicated in each case, but also in other combinations or on their own, without departing from the scope of the invention.

DETAILED DESCRIPTION OF THE DRAWINGS

Figure 1:
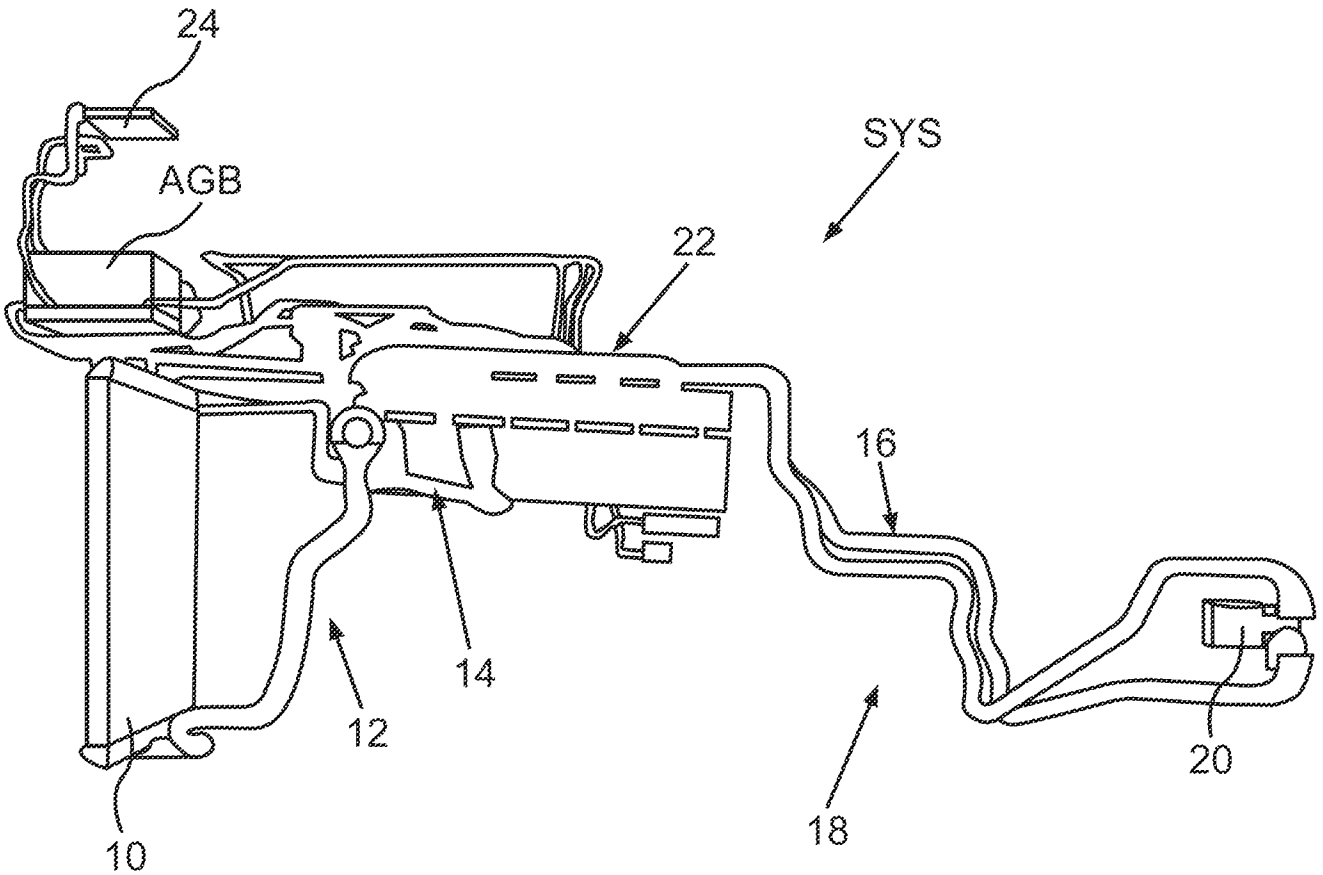
FIG. 1 is a schematic side view of a cooling system of a vehicle in the form of a commercial vehicle, wherein the cooling system is filled with a coolant, in particular a liquid coolant, by filling a quantity of the coolant into the cooling system, wherein the quantity of the coolant to be filled in is adjusted depending on the residual air volume located in the cooling system and the desired air feed $V_{L,\ AGB}$ in the compensating reservoir AGB.

FIG. 1 shows a side view of a cooling system for a vehicle, in particular in the form of a commercial vehicle, which is designed as a utility vehicle. The cooling system has at least one cooling circuit through which a coolant can flow and in which various components of the commercial vehicle are arranged. The coolant can flow through the cooling circuit and thus through the components arranged in the cooling circuit, so that the components can be cooled or also temperature-controlled as a result of heat transfer from the components to the coolant, for example in an electrically driven vehicle a battery through which coolant flows. The coolant is, for example, a liquid coolant, that is to say, a cooling liquid, which is also referred to as cooling water. The components include a coolant radiator 10, hoses 12, a cylinder head and an engine block, wherein the cylinder head and engine block are collectively denoted by 14, retarder tubes 16, heater lines 18, a retarder 20, lines 22, a heater heat exchanger 24, and a compensating reservoir AGB.

The cooling system is filled with the coolant during the production or assembly of the commercial vehicle. A method for filling the cooling system is described below. Within the scope of the method, a quantity of coolant is filled into the cooling system. The cooling system has a compensating reservoir AGB, which can be seen in FIG. 2, via which the coolant can be filled into the cooling system SYS. After the coolant has been filled into the cooling system SYS as part of the so-called prefilling process, there is still a quantity of air in the compensating reservoir AGB in addition to a quantity of coolant, as well as possible residual air quantities/air bubbles in the rest of the cooling system SYS and thus various residual air volumes in components of the cooling system SYS. This—not absolutely necessary—first process step of prefilling increases the accuracy of the method; the method becomes more accurate the more liquid and the less residual air is enclosed in the system. The various residual air quantities in the system, together with the air in the compensating reservoir AGB, result in a total residual air quantity $V_3$ and thus a total residual air volume. In order to then fill the entire cooling system, including the compensating reservoir AGB, with the correct quantity of coolant in a particularly simple and precise manner, the quantity of coolant to be filled in is determined and adjusted depending on the design-specified air volume $V_{L,\ AGB}$ in the compensating reservoir AGB and the total residual air volume in the system ascertained using this method.

Figure 2:
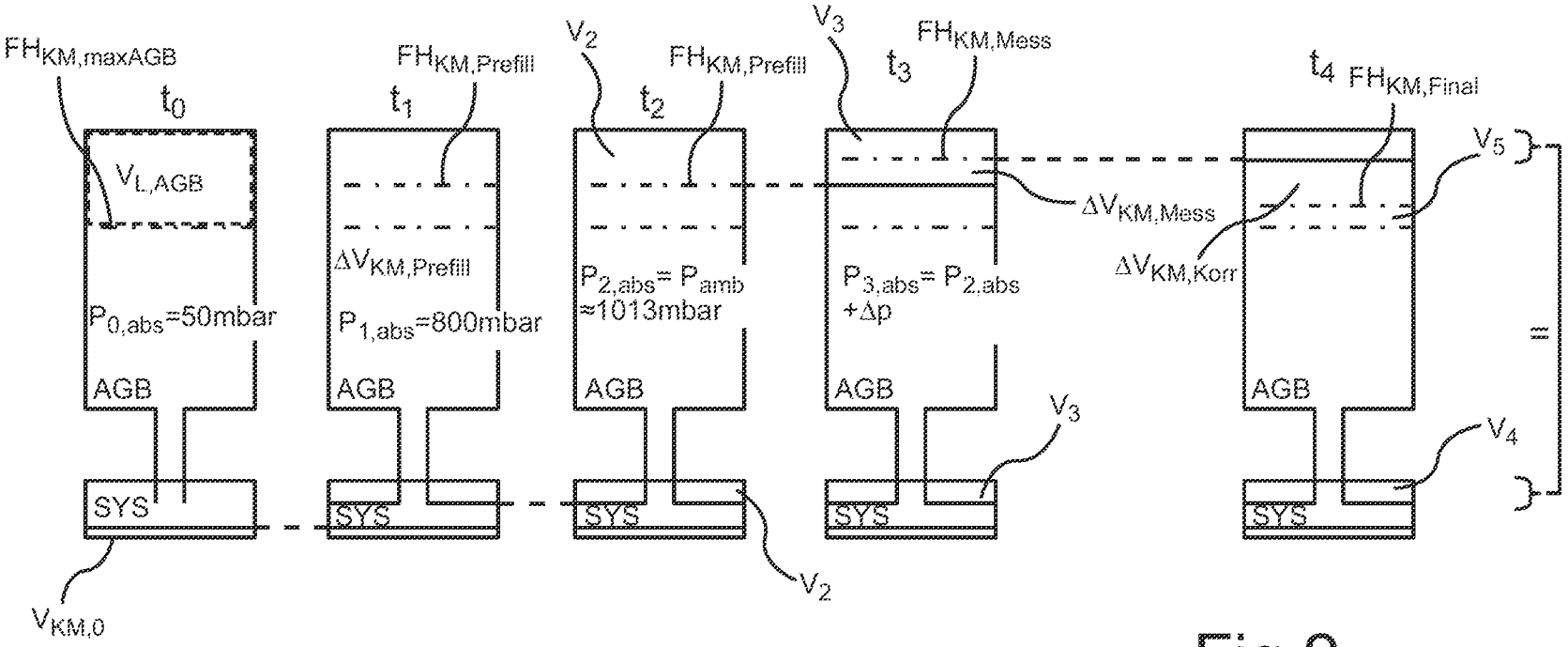
FIG. 2 is an illustration of the method according to the invention.

In FIG. 2, the hydraulic system SYS to be filled with hydraulic fluid is shown in a very highly simplified way. It comprises a compensating reservoir AGB and the rest of the hydraulic system SYS in different stages at different times $t_0$ to $t_4$.

In FIG. 2 $\dot{V}_{KM}$ denotes a volume flow with which the coolant is filled into the cooling system SYS via the compensating reservoir AGB over a certain time. $FH_{KM,max\ AGB}$ denotes the maximum filling volume of the compensating reservoir AGB in normal operation, which results from the volumetric size of the compensating reservoir AGB minus the air feed $V_{L,\ AGB}$ desired in accordance with the design, and $VKM_{Korr}$ denotes the quantity of coolant still to be filled into or extracted from the cooling system in the last process step (step 6) in order to fill the system ideally, i.e., completely, with the desired quantity of coolant. Provided that there is no air trapped in any further part of the system other than the compensating reservoir AGB, $VKM,_{Korr}$ is used to fill the system exactly up to $FH_{KM,\ max\ AGB}$. As soon as there is still a residual quantity of air elsewhere in the cooling system SYS, which may also consist of several partial quantities, the compensating reservoir AGB is overfilled by the volume $V_5$ with respect to the design-specified fluid level setpoint $FH_{KM,max\ AGB}$ by means of the method described here and the quantity VKM, $_{Korr}$, more specifically by exactly the quantity of the sum of the air volumes $V_4$ enclosed outside the compensating reservoir.

In step 1, a bar at the bottom of the system SYS indicates that an unknown quantity $V_{KM,\ 0}$ of hydraulic fluid is already in the system SYS before prefilling, usually performed as vacuum filling, begins.

For this vacuum filling, the cooling system is sealed airtight and the pressure $p_{0,\ abs}$, for example, is lowered to approx. 50 mbar absolute pressure. This negative pressure/vacuum conveys an initial volume $V_{KM,\ Prefill}$ into the hydraulic system SYS or supports and promotes rapid coolant filling. This results in a level with a filling height $FH_{KM,\ Prefill}$ in the compensating reservoir AGB. At the end of the prefilling process step (step 2), there is still a negative pressure $p_{1,\ abs}$ of, for example, 800 mbar absolute pressure in the hydraulic system. In terms of the accuracy of the method, it makes sense to determine this first volume $V_{KM,\ Prefill}$ so that the entire hydraulic system is already largely filled afterwards. For reasons of process simplification for the method, the prefill quantity should preferably be set above the approximately known total target fill quantity. As a result, a slight negative pressure remains in the system SYS at the end of the entire process after the final fill level adjustment (step 6), so that the filling head of the system can be removed after a simple pressure equalisation without undesirably forcing fluid out of the compensating reservoir AGB, or without the compensating reservoir AGB having to be equipped with a special function for reducing the excess pressure, or without a separate process step or additional system technology being required for this.

After the prefilling (step 2), the pressure in the hydraulic system is equalised (step 3) so that the pressure is equalised with the ambient pressure. After this, in the hydraulic system, an ambient pressure $p_{amb}=p_{2,\ abs}$ of, for example, 1013 mbar prevails.

Subsequently (step 4), the hydraulic system is sealed again in an airtight manner and the pressure $p_{2,\ abs}$ in the system (=ambient pressure $p_{amb}$) is recorded, i.e., measured as accurately as possible. Then, a feed pump of the filling system 32 (FIG. 3) feeds a precisely specified second volume $\Delta V_{KM,\ Mess}$ of hydraulic fluid into the hydraulic system. This increases the pressure in the hydraulic system from $p_{2,\ abs}$ to $p_{3,\ abs}$ and the filling level FH in the compensating reservoir AGB rises to the value $FH_{KM,\ Mess}$. This pressure $p_{3,\ abs}$ is also recorded, i.e., measured; alternatively, starting from $p_{2,\ abs}$, it is also possible to measure the pressure difference $\Delta p$ between before (time $t_2$) and after (time $t_3$) the filling or removal of the second volume $V_{KM,\ Mess}$. This second volume $\Delta V_{KM,\ Mess}$ of hydraulic fluid must be delivered into the hydraulic system as accurately as possible. This volume must be known for the further calculation. This volume must be dimensioned in such a way that it can still be filled into the hydraulic system without exceeding the air space currently still available in the compensating reservoir AGB.

From the absolute pressure $p_{2,\ abs}$, the pressure difference $\Delta p$ ($=p_{3,\ abs}-p_{2,\ abs}$) and in knowledge of the volume $\Delta V_{KM,\ Mess}$, for example, the residual air volume in the hydraulic system can be calculated using the ideal gas equation. The calculation of the total residual air volume of the entire system is carried out on the basis of the ideal gas equation under the assumption that the total residual air volume still contained in the entire cooling system, i.e., the air contained in the cooling system, is approximately an ideal gas and the method step measurement step (step 4) is carried out approximately as an isothermal change of state. In the sense of a highest possible accuracy of the method, it must be ensured here that the temperature of the coolant to be filled in the reservoir of the filling system 32 is controlled so as to be similar to that of the production hall of the vehicle and the vehicle and parts thereof, located in the production line.

In the knowledge of the volume $\Delta V_{KM,\ Mess}$ and the pressures $p_{3,\ abs}$ and $p_{2,\ abs}$, the total residual air volume $V_3$ can now be determined. Thus, the required final correction volume $\Delta V_{KM,\ Korr}$ can be determined simply by subtracting the desired air volume $VL,_{AGB}$ from $V_3$ (step 5).

When the final correction quantity $V_{KM,\ Korr}$ is pumped into the hydraulic system or removed therefrom, a fill level $FH_{KM,\ Final}$ is reached which is above the desired fill level $FH_{KM,\ max\ AGB}$. The fluid volume $V_5$ from the corresponding volume difference of the fill levels $FH_{KM,\ Final}-FH_{KM,\ max\ AGB}$ in the compensation reservoir AGB corresponds here exactly to the volume of the sum of the air bubbles in the hydraulic system SYS, which is denoted as $V_4$ in FIG. 2.

The total residual air volume $V_2$ in the cooling system is given by:

$$V_2=V_3+\Delta V_{KM,Mess}$$

The above equation is a first equation.

Furthermore, the following second equation is used, which represents the ideal gas law:

$$p_{2,abs}*V_2=p_{3,abs}*V_3$$

(BOYLE-MARIOTTE *law* for $T$=const,$dT$=0)

$P_{2,abs}$ denotes a coolant pressure that the coolant has in the cooling system at the time $t_2$. Accordingly, $p_{3,\ abs}$ is the pressure of the coolant in the cooling system at the later time $t_3$. As explained above, the change in the total quantity of coolant in the measuring step $V_{KM,\ Mess}$ thus leads to a change in the absolute pressures in the cooling system, wherein these pressures are recorded, i.e., measured, as precisely as possible, for example by means of a detection device, in particular by means of at least one pressure sensor. In this case, the quantity of coolant to be filled in is set by controlling the filling time ($t_3$-$t_2$) at a given constant volume flow with which the coolant is filled into the cooling system over this time.

$$V_{KM,Mess}=\dot{V}_2(t_3-t_2).$$

If these three equations are inserted into each other, the following results for $V_3$:

$$V_3=\frac{p_{2,abs}*\dot{V}_{KM}*(t_3-t_2)}{(p_{3,abs}-p_{2,abs})}$$

A volume $V_{KM,Mess}$ in the compensating reservoir AGB shown in FIG. 2 indicates the quantity of coolant filled into or removed from the compensating reservoir AGB between the times $t_2$ and $t_3$. Accordingly, a volume $V_{KM,\ Korr}$ denotes the quantity of coolant filled into or removed from the compensating reservoir AGB between the times $t_3$ and $t_4$. This quantity corresponds to the quantity $V_{KM,Mess}$ of coolant still to be filled into or removed from the cooling system so that the cooling system is optimally filled, i.e., exactly according to the design specification:

$$V_{KM,Korr}=V_3-V_{L,AGB}.$$

More precisely, $V_{KM,Korr}$ refers to a volume of coolant still to be filled into or removed from the cooling system via the compensating reservoir AGB or in a similar manner. Overfilling of the compensating reservoir beyond the design-specified level is accepted; the cooling system will relatively quickly separate the unwanted residual air volumes/air bubbles in the compensating reservoir during subsequent real vehicle operation. This normally requires the opening of the engine coolant thermostat, which regularly occurs during driving when the thermostat opening temperature of the coolant is reached. If the method is carried out in such a way that the prefill quantity is already above the final target quantity, a slight negative pressure is created in the last step of the method at the end of the final level setting.

In the event that the final level setting of the compensating reservoir AGB is to be achieved via a filling, this must be done with a slight negative pressure in the system, provided that the AGB contains an overfill protection design. This overfill protection is usually present in a compensating reservoir to ensure that an undesired overfilling of the cooling system is avoided during later customer use.

If the quantity $V_{KM,\ Korr}$ of coolant calculated in the manner described above is filled into or removed from the cooling system, a volume of coolant is created in the compensating reservoir AGB which leaves room for a quantity of air in the compensating reservoir AGB which, in conjunction with the air bubbles still present in the system, results in exactly the desired air feed $V_{L,AGB}$ of the cooling system.

Preferably, the method of air volume determination is to be carried out in the positive pressure range, as this avoids an undesired contraction and thus an internal volume change due to contraction of the rubber hoses of a hydraulic system, which are usually present in a hydraulic system.

The aim of the method and thus an ideal filling of the cooling system is to make the system robust against possible shortfalls when filling the cooling system, as well as to be able to deliberately allow smaller shortfalls, i.e., air pockets in the system, in order to save on costly vent lines or technical/design effort for continuously rising lines required by design.

Figure 3:
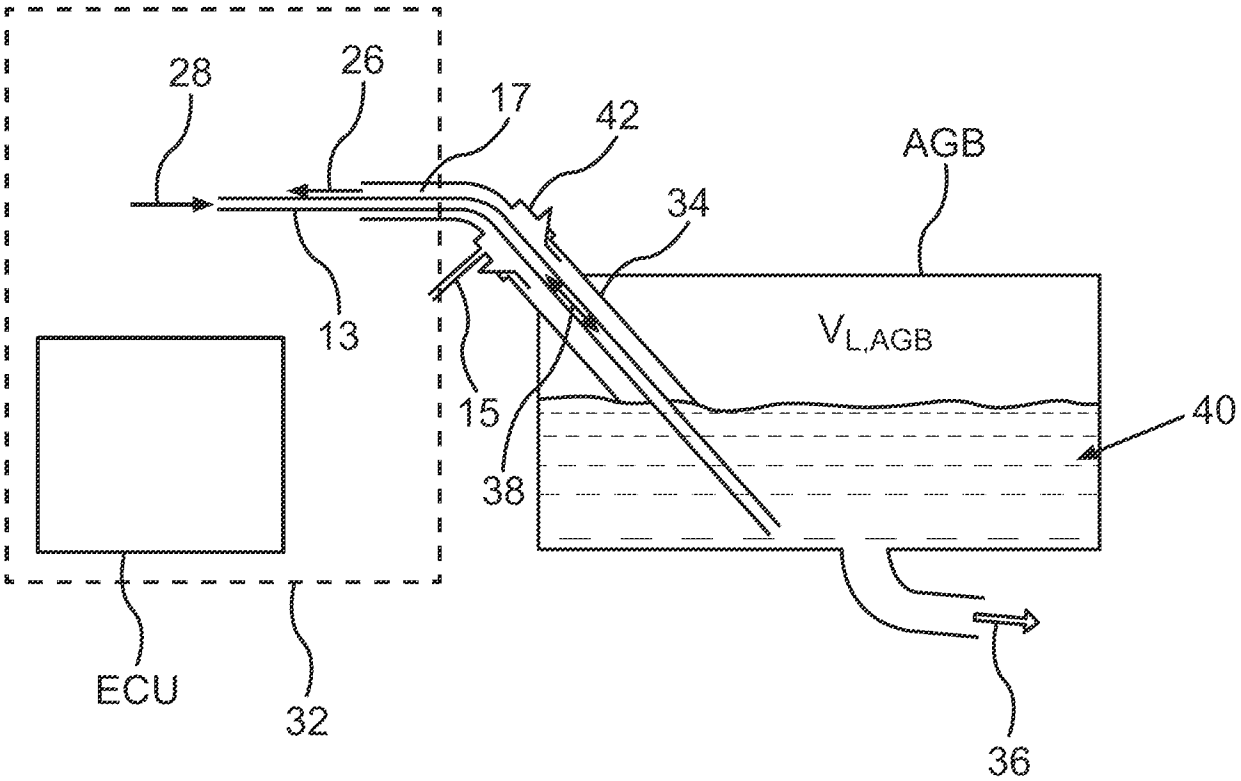
FIG. 3 is a schematic representation of the filling device according to the invention.

FIG. 3 schematically shows an exemplary embodiment of a filling device referred to as a filling system 32. A filling adapter 42 is received in the filler neck 34 of the compensating reservoir AGB. The filler neck 34 has an overfill protection. The filling adapter comprises a line 13 for filling with hydraulic fluid and a connection 15 for a pressure sensor (not shown).

Optionally, the filling adapter 42 comprises a suction line 17, which is required to carry out the vacuum filling. By sucking air out of the compensating reservoir AGB with the help of a vacuum pump, the pressure in the hydraulic system SYS drops to, for example, 50 mbar. After that, the vacuum filling with the first volume $V_{KM,\ Prefill}$ can take place (step 2).

The pressure sensor is used to record the absolute pressures $p_{2,\ abs}$ and $p_{3,\ abs}$. The quantity of coolant filled in or removed must be recorded as precisely as possible using appropriate quantity measuring devices, especially in the measuring step (step 4).

A control unit ECU is set up and programmed to control the vacuum pump and the filling and/or suction pumps. It controls the filling with the first volume $V_{KM,\ prefill}$, the second volume $\Delta V_{KM,\ Mess}$, and the final adjustment volume/correction volume $V_{KM,\ Korr}$. It also controls the recording of the pressures $p_{2,\ abs}$, $p_{3,\ abs}$ and the quantity of coolant filled or removed in each measuring step and calculates the volume $V_3$ of the total residual air in the hydraulic system and calculates the final adjustment volume/correction volume $V_{KM,\ Korr}$.

To carry out the method it is irrelevant here whether the change in volume $V_{KM,Mess}$, which is required to set the second later measuring time (time $t_3$), is volume-controlled, i.e., by a predefined volume $V_{KM,Mess}$ and the resulting pressure change is measured, or whether the quantity $V_{KM,Mess}$ filled or removed in the measuring step (step 4)—then initially unknown—is filled or removed in a pressure-controlled manner, i.e., until a predefined pressure is reached, and this resulting quantity $V_{KM,Mess}$ is measured as accurately as possible. Volume control is usually advantageous because stabilising the pressures in the system takes some time and pressure control would usually result in slower process times.

In particular, the control unit ECU is an electronic control unit of the filling system 32 for controlling the filling process, the relevant measurement data acquisition, and the calculation of the particular coolant quantities. Furthermore, the coolant in the compensating reservoir AGB is denoted by 40 in FIG. 3. An arrow 36 indicates that the coolant 40 can flow from the compensating reservoir AGB to or into the cooling system SYS. A double arrow 38 indicates that coolant can be removed from the compensating reservoir AGB via the line 13 and that coolant can be filled into the compensating reservoir AGB. An arrow 28 indicates that coolant of known quantity and temperature can be introduced into the line 13 from the reservoir of the filling system 32, which is also referred to as the system reservoir, and can be introduced into the compensating reservoir AGB via the line 13. Lastly, an arrow 26 illustrates a connection to the air extraction for partial evacuation and to the ventilation/pressure equalisation valve.

The invention claimed is:

1. A method for filling a hydraulic system (SYS) with a hydraulic fluid (40), comprising the steps of:

sealing the hydraulic system (SYS) in a pressure-tight manner and recording a pressure ($p_{2,\ abs}$) in the sealed hydraulic system (SYS);

filling or removing a predefined second volume ($\Delta V_{KM,\ Mess}$) of the hydraulic fluid (40) from the sealed hydraulic system (SYS);

recording a pressure ($p3,\ _{abs}$) in the sealed hydraulic system (SYS) after the filling or removing of the predefined the second volume ($\Delta V_{KM,\ Mess}$);

calculating a volume ($V_3$) of a total residual air in the hydraulic system (SYS) depending on the pressures ($p_{2,\ abs}$, $p3,\ _{abs}$) before and after the filling or removal of the predefined second volume ($\Delta V_{KM,\ Mess}$) and calculating a final correction volume ($V_{KM,\ korr}$) depending on the volume ($V_3$) and a design-specified air feed ($V_{L,\ AGB}$) of the hydraulic system (SYS); and refilling or removing the calculated final correction volume ($V_{KM,\ Korr}$) to achieve a final correct filling quantity for the hydraulic system (SYS);

wherein the final correction volume ($V_{KM,\ Korr}$) is calculated such that a level of the hydraulic fluid (40) after filling the hydraulic system (SYS) with the final correction volume ($V_{KM,\ Korr}$) is above a highest level (FHKM, $_{max\ AGB}$) permanently permissible during operation;

wherein after filling the hydraulic system (SYS) with the final correction volume ($V_{KM,\ Korr}$), a volume ($V_5$) of the hydraulic fluid (40) in a compensating reservoir (AGB) corresponding to a residual air volume ($V_4$) is produced above the highest level (FHKM, $_{max\ AGB}$) permanently permissible during operation.

2. The method according to claim 1, further comprising the step of filling the hydraulic system with a predefined first volume ($V_{KM,\ Prefill}$) of hydraulic fluid before the sealing and the recording of the pressure ($p_{2,\ abs}$) in the sealed hydraulic system (SYS).

3. The method according to claim 2, wherein the hydraulic system (SYS) is filled with the predefined first volume ($V_{KM,\ Prefill}$) of hydraulic fluid (40) by negative pressure.

4. The method according to claim 1, wherein the final correction volume ($V_{KM,\ Korr}$) is determined depending on the total residual air volume minus a target air volume.

5. The method according to claim 1, wherein the hydraulic system (SYS) is filled with the hydraulic fluid via a compensating reservoir (AGB).

6. A method for filling a hydraulic system (SYS) with a hydraulic fluid (40), comprising the steps of:

sealing the hydraulic system (SYS) in a pressure-tight manner and recording a pressure ($p_{2,\ abs}$) in the sealed hydraulic system (SYS);

filling or removing the hydraulic fluid (40) from the sealed hydraulic system (SYS) until a predefined pressure ($p3,\ _{abs}$) is reached in the sealed hydraulic system (SYS) and recording a volume ($\Delta V_{KM,\ Mess}$) of the hydraulic fluid (40) filled in during the filling or removing;

calculating a volume ($V_3$) of a total residual air in the hydraulic system (SYS) depending on the pressures ($p_{2,\ abs}$, $p3,\ _{abs}$) before and after filling or removing of a second volume ($\Delta V_{KM,\ Mess}$) and calculating a final correction volume ($V_{KM,\ korr}$) depending on the volume ($V_3$) and a design-specified air feed ($V_{L,\ AGB}$) of the hydraulic system (SYS); and refilling or removing the calculated final correction volume ($V_{KM, Korr}$) to achieve a final correct filling quantity for the hydraulic system (SYS);

wherein the final correction volume ($V_{KM, Korr}$) is calculated such that a level of the hydraulic fluid (40) after filling the hydraulic system (SYS) with the final correction volume ($V_{KM, Korr}$) is above a highest level (FHKM, $_{max\ AGB}$) permanently permissible during operation;

wherein after filling the hydraulic system (SYS) with the final correction volume ($V_{KM, Korr}$), a volume ($V_5$) of the hydraulic fluid (40) in a compensating reservoir (AGB) corresponding to a residual air volume ($V_4$) is produced above the highest level (FHKM, $_{max\ AGB}$) permanently permissible during operation.

7. The method according to claim 6, further comprising the step of filling the hydraulic system with a predefined first volume ($V_{KM, Prefill}$) of hydraulic fluid before the sealing and the recording of the pressure ($p_{2, abs}$) in the sealed hydraulic system (SYS).

8. The method according to claim 7, wherein the hydraulic system (SYS) is filled with the predefined first volume ($V_{KM, Prefill}$) of hydraulic fluid (40) by negative pressure.

9. The method according to claim 6, wherein the final correction volume ($V_{KM, Korr}$) is determined depending on the total residual air volume minus a target air volume.

10. The method according to claim 6, wherein the hydraulic system (SYS) is filled with the hydraulic fluid via a compensating reservoir (AGB).

11. A device for filling a hydraulic system (SYS), comprising:

a filling adapter (42);

a line (13) for hydraulic fluid (40);

a pressure sensor;

a means for closing the hydraulic system (SYS); and a control unit (ECU);

wherein the device performs the method according to claim 1 or claim 6.

* * * * *